United States Patent [19]

Brown et al.

[11] Patent Number: 4,646,369

[45] Date of Patent: Mar. 3, 1987

[54] FLUSHING CISTERNS

[75] Inventors: Geoffrey J. Brown, Luton; John C. Griggs, St. Albans; John Hall, Watford, all of England

[73] Assignee: National Research Development Corporation, London, England

[21] Appl. No.: 763,986

[22] Filed: Aug. 9, 1985

[30] Foreign Application Priority Data

Aug. 9, 1984 [GB] United Kingdom ..... 8420287
Aug. 9, 1984 [GB] United Kingdom ..... 8420286

[51] Int. Cl.[4] ..... E03D 1/02

[52] U.S. Cl. ..... 4/365; 4/353; 137/133; 137/410

[58] Field of Search ..... 4/353, 363, 365, 346; 137/432, 428, 410, 127, 133

[56] References Cited

U.S. PATENT DOCUMENTS

| | | | |
|---|---|---|---|
| 536,150 | 3/1895 | Keller | 4/365 X |
| 546,595 | 9/1895 | Politsky | 4/365 |
| 551,514 | 12/1895 | Sherman | 4/365 |
| 552,015 | 12/1895 | Thomson | 4/346 |
| 576,006 | 1/1897 | Tilden | 4/365 X |
| 682,568 | 9/1901 | Rhind | 4/365 |
| 1,182,957 | 5/1916 | Wright | 4/365 |
| 1,670,975 | 5/1928 | McCleery | 4/365 |
| 1,688,797 | 10/1928 | Bartosik | 4/365 |
| 1,754,990 | 4/1930 | Esnard | 4/365 |
| 2,199,068 | 4/1940 | Egenas | 4/365 |
| 2,212,943 | 8/1940 | Kolarik | 4/365 X |
| 2,349,015 | 5/1944 | Stalcup | 4/365 |

FOREIGN PATENT DOCUMENTS

| | | | |
|---|---|---|---|
| 385629 | 11/1923 | Fed. Rep. of Germany | 4/365 |
| 1120745 | 6/1956 | France | 4/365 |
| 161374 | 4/1921 | United Kingdom | 4/365 |

*Primary Examiner*—Henry K. Artis
*Attorney, Agent, or Firm*—Cushman, Darby & Cushman

[57] ABSTRACT

A flushing cistern to produce an energetic flush with a reduce volume of water, some 5 or 6 liters for low-level use. The cistern has a housing supporting a rotatable water holder having a large flow aperture in a curved surface and otherwise closely conforming to the inside of the housing. The flush outlet is a large tapering outlet of hydraulically-efficient form to which the aperture matches when the holder is rotated to produce a flush. The filling of the water holder can be arranged to occur only when the holder is in the correct position. Fault conditions are indicated by a warning flow of water from an overflow or elsewhere.

17 Claims, 4 Drawing Figures

FLUSHING CISTERNS

Figure 1:
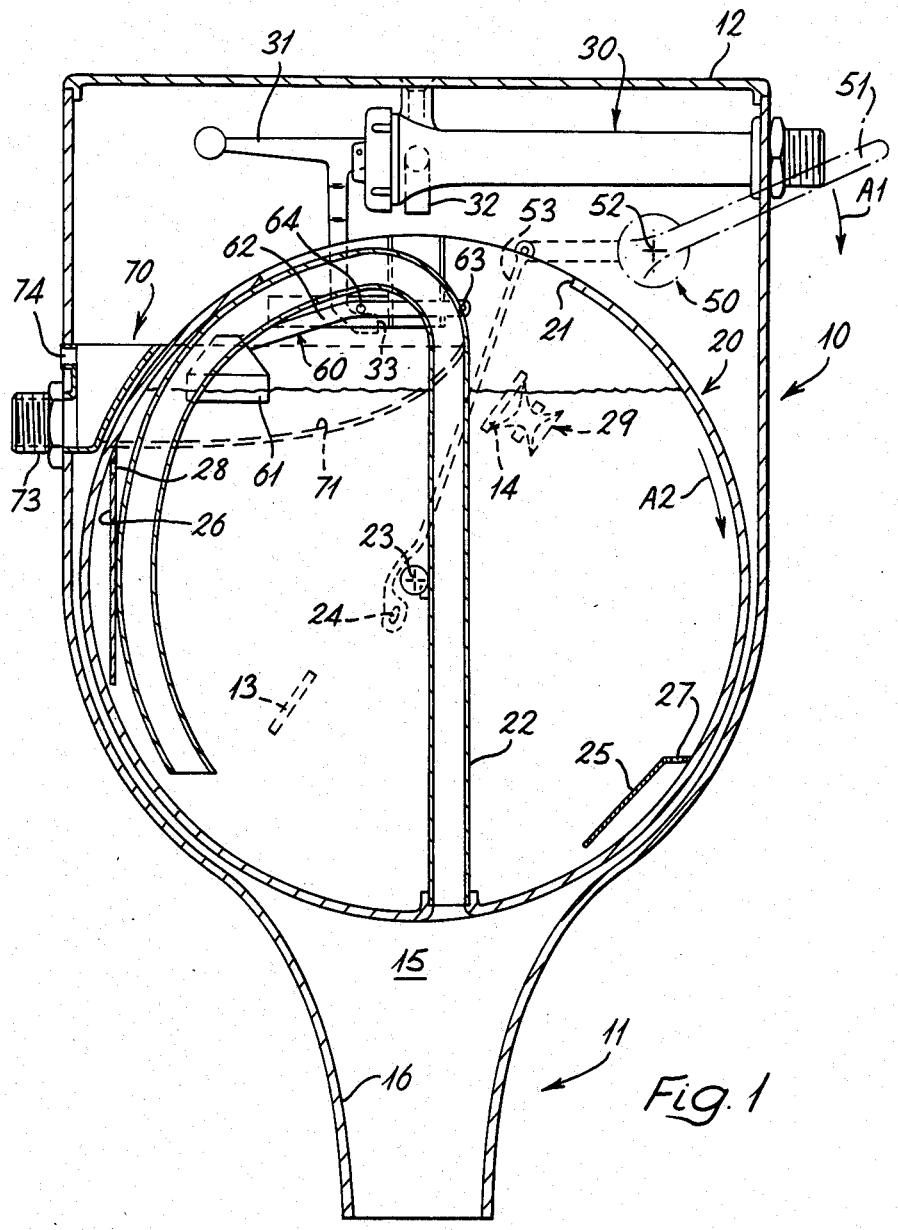

This invention relates to a flushing apparatus, such as is used with water closets and the like and for other purposes.

A flushing apparatus is required to reliably deliver in a short time a set quantity, or one of two or more set quantities, of water and then refill from a supply, which generally can not provide the set quantity in this short time, to be ready to make another delivery. For reliable operation the apparatus must control the supply of water to shut it off when the apparatus is refilled. To warn of failure to shut off the supply the apparatus should release surplus water in a safe manner, e.g. via a warning pipe. Many pieces of apparatus have been proposed to achieve some of these results. Some proposals make use of a siphon, some use tilting or turning inner vessels. A current requirement is the efficient use of water and instead of the earlier regulations requiring a large-volume flush (say 2 gallons or 9 liters) the requirement is now for the effective use of the minimum volume of flushing water.

It is an object of the invention to provide an effective and economic flushing apparatus, such as a water waste preventer cistern.

According to the invention there is provided a flushing cistern including a cistern body having a water supply path and a flushing water outlet and inside the cistern body a rotatable water holder, in which the water holder and the inside of the cistern body closely conform in shape, and support means support the water holder in the cistern body for rotation with the holder in close conformity with the body, the water holder has an aperture for unrestricted water flow the cistern further includes means to position the water holder to receive water suppliable, in operation, over the supply path and means to direct and control the supply of water in the cistern to permit such supply only when the holder is in the position to receive water to charge the holder and to provide in fault conditions an indicating flow, the flushing water outlet of the cistern body has an enlarged entry to match the unrestricted water flow aperture of the water holder and continues by a flow-assisting reducing transition, and the cistern includes means to rotate the water holder from the position to receive water, through a region in which said close conformity obstructs said aperture, to a position to match said aperture to said outlet entry to there discharge the water holder freely, to cause, in operation, a charge of water in the holder to form a flushing water flow for utilisation.

The water holder aperture may be shaped to be part of a flow-assisting reducing transition.

There may be means to provide an "after flow" of water at the end of a flush.

Conveniently the water holder includes at least one holder bias means to respectively or together urge the holder to the inverted position, cause return to the upright position and control the movement of the holder.

The housing by conforming to the water holder may prevent water diverting from the transfer path.

The water holder bias means may include one or more pockets to retain water after said release of water from the holder. A pocket may have one or more vent holes of selected size to control fluid flow into and out of the pocket. A baffle, with a similar vent hole or holes, may also be provided.

The water holder may be of generally cylindrical form and mounted to rotate in a closely conforming housing. There may be means operable by hand to cause the holder to rotate.

There may be in the means to direct and control the supply of water means to allow flow only when the water holder is in position, means to receive and direct the allowed flow to an outlet as a fault indication and flow deflector means to deflect the allowed flow into the water holder.

There may be a bias in the supply means to prevent the supply of water and the water holder may include means to indicate the charge quantity and override said bias when the charge quantity is less than a full charge.

According to a particular aspect of the invention there is provided a flushing apparatus including a housing having a utilisation outlet and in the housing a water holder having a flow aperture, means to support the water holder in the housing for inversion in the housing, means to charge the water holder, means to invert the water holder, means to vent the inverted water holder, the housing conforming to the water holder in the inverted position, where the outlet and aperture co-operate to form a low loss water transfer path to release water from the holder for utilisation.

According to another aspect of the invention there is provided a flushing cistern apparatus charging arrangement including flow control means to allow the flow of water into said apparatus, overflow means to receive said flow of water and direct the flow to an overflow outlet as a fault indication, and flow deflector means movable to divert said flow away from the overflow means to direct water from the flow, in operation, as a charge of flushing water for the apparatus.

Figure 2:
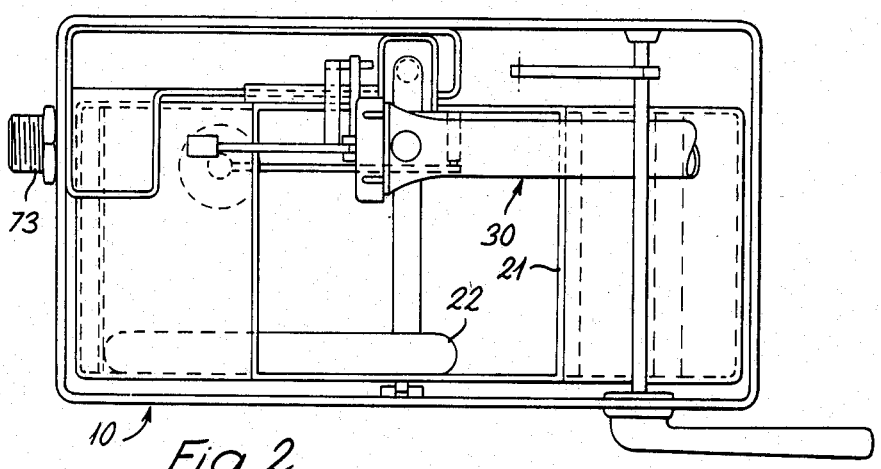
Figure 3:
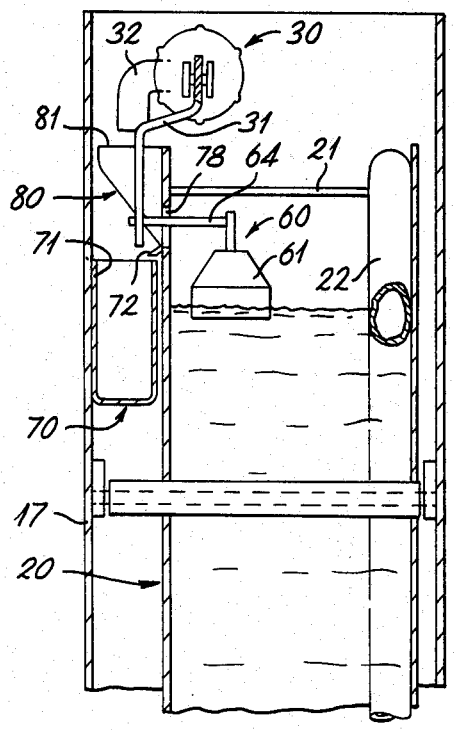
Figure 4:
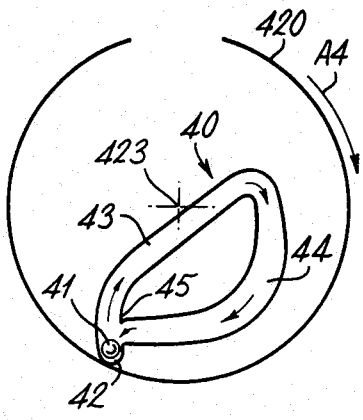

Embodiments of the invention will now be described with reference to the accompanying drawings in which:

FIG. 1 is an elevation, partly in cross-section of a flushing apparatus embodying the invention and in the charged position, FIGS. 2 and 3 are respectively plan and side views partly in cross-section of the apparatus in FIG. 1, and FIG. 4 shows a form of bias device for the apparatus.

In FIG. 1 there is shown a housing 10 having a water outlet 11. The housing may have a lid 12 which is preferably close-fitting for stiffness and noise-reduction. Specific forms are shown in the Figures but, apart from constraints and requirements mentioned herein other forms may be used.

The housing 10 is provided with a water holder 20 and means 30 to supply water to the water holder. A mechanism operable by hand to cause the discharge of the water holder ("flushing") is indicated at 50. The various elements such as the water holder, water supply means and mechanism to cause discharge may be varied, subject to constraints and requirements herein. An important aspect is that the water holder need only contain 6 liters (about $1\frac{1}{4}$ Imperial gallon) of water, or even 5 in some circumstances, so a compact unit can be produced.

In the form specifically illustrated the water holder 20 is of generally cylindrical form and supported in the housing 10 to be movable to discharge water from the holder. This may be achieved by having the generally cylindrical form supported to rotate on the axis of the cylinder and turn through about 180° from an upright to an inverted postion. Rotations of other than 180° may be used. In the illustrated form a flow aperture such as an opening 21 in the cylindrical or other curved surface of the water holder 20 is at the top when the holder 20 is charged and at the bottom to discharge the water holder. However a rotation of less than 180° may be used for example if the opening 21 is to one side when the holder is charged, provided enough water is held. The back wall 17 of the housing can be shaped towards the water holder to restrict the movement of water during discharge, for example by local projections which allow the water holder and its attachments clear passage but reduce the volume for water diversion. The housing has an outlet 11 through which water flows to be used for flushing, e.g. via a suitable connection to a w.c. pan.

Charging of the water holder is provided for by causing the supply means 30 to be operated to supply water when the holder opening is in a position to receive water. Preferably the apparatus is arranged to ensure that water is not supplied except when the holder opening is correctly positioned and to ensure that if water is still so-supplied the water is properly disposed of. To these ends a linkage 60 is arranged to control the operation of the supply means and an overflow 70 is included.

FIG. 1 is now considered in specific detail. The housing 10 is of a suitable material, such as plastics, ceramic or metal, chosen to be corrosion resistant and durable and capable of taking a suitable finish for decorative purposes. Moulding is a convenient manufacturing process. In distinction from earlier proposals the housing has a shape, internally at least, which is chosen to provide a flow path which is hydraulically efficient. To this end the outlet 11 is made to taper, in a quarter-elliptic or cubical curve form, from a large entrance 15 to a conventional exit size via a transition 16 to achieve good water flow with reduced friction and turbulence. Clearly an approximation to the exact geometric form can be used with appropriate variation in performance.

The water holder 20 is conveniently cylindrical and with an axial dimension less (say one-half or one-third) than the diameter. Other proportions may be used. For low-level suites the housing is conveniently thin, high and not too wide to reduce the space occupied. This employs a short fat cylinder and also gives a usefully high head of water. For other applications, for example a high-level fitting, a long thin cylinder may be used with its axis parallel to the mounting surface of the cistern. For high-level fitting a smaller volume of water may be used, less than 5 or 6 liters, as the greater "head" assists the flushing action. The material is conveniently plastic to produce a light strong holder of good dimensional stability with a long life when in contact with water. Polyethylene or other approved materials should be used where appropriate. Moulding and fabrication are suitable manufacturing process in view of the shape of the holder. The cylindrical holder is mounted by suitable means such as stainless steel pivot pins in bosses moulded in the plastic material, to rotate about axis 23. A "drop-in" mounting arrangment can be used. A ball-race may be used for the more heavily loaded rear bearing. The discharge mechanism 50 is eccentrically pivotted to the holder at 24 by link 53 so that movement of operating lever 51 in direction A1 on pivot 52 moves link 53 to rotate the holder 20 in direction A2. A bias weight may be used, attached to the water holder to bias it into the position shown in FIG. 1 when empty.

When the holder 20 is cylindrical or generally cylindrical the housing 10 can be shaped, internally at least, to conform closely to the curved form of holder 20. In particular the circular ends are complete apart possibly from an overflow aperture. This helps to contain the water in the holder, when the holder is rotated in the housing discharge for flushing, by obstructing the escape of water from opening 21 until the outlet 11 is reached when the charge of water can be "dumped" from the large opening 21 into the outlet 11 for low-loss transfer to produce a vigorous flush. The "dumping" of the charge is assisted by the air-tube 22 which provides a good flow of air into the space above the water in the inverted holder to break any vacuum restricting the flow. A clearance between the water holder and the housing of about 3 to 5 millimeters is suitable, depending on tolerances and stability of the materials chosen. The opening 21 is made as large as possible to assist in the "dumping" action.

The water holder is assisted and controlled in its movement by two pockets, 25, 26, which can retain water when the rest of the charge is being discharged. Both pockets have one or more holes, 27, 28. The hole, or holes, in pocket 26 are larger or more numerous than the hole or holes in pocket 25 so that pocket 26 drains much more quickly than pocket 25. The exact size of the pockets and holes depends on the construction of a specific apparatus. The pocket 26 can assist the holder to move to the inverted position, when lever 51 is operated, but its main function is to help keep the holder inverted while the charge is discharged.

The function of pocket 25 is to bias the discharged, inverted holder to return to the upright position, where the hole 27 ensures complete release of water from the pocket. The holes also ensure the proper filling of the pockets during charging of the holder by venting trapped air. An important feature of the construction described is the reliable restoring of the water holder to the charged position which the bias pockets provide even if bearing friction rises during uses.

It is helpful to include a baffle plate in the water holder attached to pocket 26 near hole 28. The plate is generally radial in position, the full depth of the water holder from front to back and cut away around air-tube 22 to provide a vent on filling. The plate can be braced against water action as it moves down through the charge before discharge occurs. The baffle acts to absorb excess rotational energy, for example on over-vigorous use of lever 51.

A further water pocket can be provided on the outside of the back surface of the water holder as an arcuate chamber at the top of the periphery adjacent chute 81 (below) and to the side of the vertical centre line away from the air-tube 22. This pocket has a wall along the water holder periphery and an opening opposite the wall to fill the pocket during discharge, when the pocket is downwards. The pocket has a small vent, outside the water holder, to allow water to escape slowly during the return of the water holder and slow down the return. The water from the vent forms a later part of the discharge to outlet 11, and could form an "after flow" if required.

A resilient element 29 is attached to the cylinder 20, on the outside of the rear wall, to co-operate with stops 13 and 14 on the inside of the housing 10 which stops define the travel of the water holder between upright and inverted postions. It will be apparent that these travel-defining elements can have various forms. For example small suction-cups with bleed holes can be used as element 29 to absorb energy from the drum and temporarily retain it, stopping "bounce".

FIGS. 2 and 3 show the arrangement, behind the water holder 20, of the water supply means 30, overflow 70 and the arrangement 80 to direct water into the holder.

The exact form of the arrangement generally indicated at 80 is important. Firstly, bye-laws in certain countries require that water from the supply means goes only into the charge of water or is directed to overflow. To ensure reliable transfer of water from the outlet of means 30 to the water holder 20, despite possible splashing and component tolerances, all the water must be caught. As shown in FIG. 3 a chute 81 is used and this rotates with the water holder. In another embodiment a shaped tube is used to convey water further down into the water holder to reduce turbulence. Advantageously the bore of this tube increases, possibly at a step-change in cross-section or direction, and the top end of the tube is set as close as possible to the outlet 32 of the supply means as initial tolerances and expected wear permit. The supply means desirably includes means to set a flow rate at which turbulence in the water holder is small or non-existent. These means may be the set of restrictors provided with some valves. It is also desirable to use a filter in the valve in certain water conditions, as will be apparent to those skilled in the art, to prevent malfunction due, for example, to particles in the water.

Item 80 in the illustrated embodiment includes a chute 81 attached to or forming part of water holder 20 to be rotated with holder 20.

The water supply means 30 can be any suitable valve but is conveniently a diaphragm valve in which the diaphragm is urged to seal an outlet port by the action of a weighted crank 31 on a follower.

Convenient forms of valve are those known as microvalves or equilibrium valves. One example of the latter is the Torbeck (RTM) Mark II (F). This is modified to be normally closed and only opened when required to deliver water. It is useful if the supply means also includes a shut-off tap, not shown, for example in the body 30. The valve is not shown in detail. The valve is kept in the closed position, to stop the flow of water, except when the crank 31 is displaced against its own weight. The water from supply means 30 is directed, for example by the nozzle 32, to flow into an overflow collector 71 positioned below the nozzle 32. Collector 71 is preferably of smoothly curved form to produce rapid flow. Chute 81 is arranged to be interposed between nozzle 32 and collector 71 when the water holder 20 is in the position to receive and retain a charge of water. In this way water from supply means 30 which does not enter chute 81 is generally caught by collector 71 and directed to an overflow exit 73. Of course in correct operation water is only supplied when chute 81 is in the correct postion but the arrangement provides a ready indication of incorrect operation with a flow of water from overflow 73. If the water holder 20 becomes overfull water flows through aperture 78 down flange 72 and into the overflow collector.

As mentioned above weighted crank 31 closes the supply means 30 except when displaced. On the return of the discharged water carrier to the upright position the linkage 60 supported in the carrier assumes a position to displace the crank 31 and cause the supply of water. Linkage 60 includes a float 61 pivoted at 63 on arm 62. Arm 62 carries rod 64 which projects through aperture 78 to engage crank 31. When water holder 20 is empty and generally upright the float 61 falls to pull rod 64 onto the lower edge of aperture 78. In this position rod 64 can engage end 33 of crank 31 and displace crank 31 to open the supply 30. As this will happen when chute 81 is in position to receive water the water holder will then be charged. When the water in holder 20 reaches the required level it causes float 61 to rise and disengage rod 64 from end 33 of crank 31 to permit the weighted crank to shut the valve.

It is an important feature that the flow of water from supply means 30 should only occur when the holder 20 is in position to receive it via chute 81. In any other position water should not flow. If, however, it does the collector 71 will receive the flow and discharge it to an overflow as an indication of a fault. Conveniently the supply means 30 fails to full bore flow and the overflow is sized to dispose of such a flow. Similarly overcharging will be released through the overflow via aperture 78. These arrangements should prevent the flow of water from outlet 11 except when a flush is required. Also water from the supply does not flow during the flush as the valve is kept closed until the holder 20 returns, in distinction from the conventional siphon cistern. If the water holder jams in an intermediate position some water may be deflected by chute 81 and provide the charge while the rest escapes to overflow. If an overflow connected at 73 is blocked a secondary outlet 74 produces a direct discharge as a warning of a serious problem.

Clearly in areas where regulations do not require an external overflow then overflow via outlet 11 can be permitted if this also is acceptable. In this case the supply means 30 can even be positioned over the water holder to discharge directly into it, with suitable adjustment to linkage 60. The supply means 30 can even be operated by the return of holder 20 towards the charging position. The closing of the valve in supply means 30 can be ensured by providing a specific movement of the holder 20 when almost full, to give a firm final closing action on the valve. For example a pocket in the holder 20 can be filled only over a weir. (Such arrangements are well-known in the art, e.g. UK Patent Speficiation 428857 and UK Patent Specification 161374.) However other arrangements can be made to give a firm final closing action which do not require a weir or special water pockets. Thus a protrusion into the water holder near the flow aperture level can be used to cause a bias to be applied to the water holder only when nearly full by reducing the volume of water on one side of the holder and providing a turning action as the fully charged condition is reached. This arrangement can adversely affect the discharge by reducing the bias holding the water holder in the inverted position unless care is taken with the design.

The operating linkage 50 is housed in the space behind the cylinder needed for the overflow arrangement. However the linkage is slim so if the overflow is moved or modified the housing 10 can be made slimmer. Other forms of linkage e.g. a chain or cord around a drum may be used. As the holder 20 can be biased by the pocket 26 during discharge an action which merely tips the holder 20 past a bias balance position may be enough. This could be provided by a gear on lever 51 engaging teeth around part of the periphery of holder 20. The linkage 50, or its alternatives, can be arranged for selective left or right hand operation if required. A lost-motion linkage can be included to protect the linkage and drum against over-vigorous or rapidly repeated action. In one form of lost-motion linkage the shaft of the operating handle carries a fork fast on the shaft instead of the fixed linkage shown. The fork has tines between which is a lever freely pivotted on the shaft. This lever is then connected to link 53. The lever has a cross-pin to rest on the upper sides of the tines. On pressing the handle 51 the fork lifts the lever via the cross-pin and turns the water holder to discharge it, as before. However the lever stays lifted until the water holder returns empty while the handle is restored by a return spring. Until the water holder returns the lever is held out of reach of the fork.

One cistern constructed in accordance with the techniques described above provided the following performance. The cistern was charged in 30 to 50 seconds. This compares with a UK Code of Practice requirement of a 2 minute cycle of operation (charge and discharge). On discharge, for flushing, the cistern was discharged, in the free air mode, in 2 seconds. For a nominal 5 liter capacity this is a discharge rate of about 2.5 liters/-second. For comparison conventional siphonic cisterns of the current nominal 2 gallon (9 liter) size are considered to have a very good performance if they discharge at an average of 2 liters/second, with anything above 1.5 liters/second being considered reasonable, again in the free air mode. A further point is the way the flow varies during the discharge. A siphonic cistern has a rapidly changing flow rate due partly to the rapidly falling "head" of water during operation. There is a very rapid rise in flow to an initial peak rate of some three times the average (up to say 6 liters/second) followed by a decay as the siphon continues to operate. A cistern using the techniques described herein can sustain a much more even flow throughout the discharge. This sustained flow is considered to give better cleaning and scouring of deposits when flushing a toilet pan. The above flow is for an outlet of 45 mm diameter at 11. If the outlet is 35 mm, which is the present normal size of the flush pipe, a flow of 1.9 liters/second is achieved, still with the even flow, to give a discharge in less than 2.5 seconds. In practice it is expected that the cisterns will have a capacity of not more than 6 liters.

The use of an internal water holder reduces noise as the housing is not subjected to water impact during filling.

When part of the water holder forms part of the flow path the holder in the region of outlet 21 is modified to provide a curve which is of the required form. This means that only the narrower part of the flow path need be formed by the housing. This can ease the moulding of the housing and possibly reduce the overall height of the housing. It is also possible to have an asymmetrical shape for the flow opening of the water holder and the outlet of the housing while still retaining a hydraulically efficient flow path. This can be combined with a supply means away from the centre of the housing and shaping the flow aperture to both provide a guide for water to enter the holder and to form a pocket to delay water as a bias on discharge.

In another arrangement the pockets that control and assist the movement of the water holder can be replaced with a dynamic bias device such as a ball free to roll in a tube. Although such a device may appear less attractive than the pockets already described it has advantages. Thus no water is needed to make the device operate. This is useful for test and demonstration use. The device can act as an energy absorber so that violent rotation of the water holder when empty is less easy to achieve.

In one form the bias device is a straight tube attached to the water holder parallel to a diameter and just offset from the centre of rotation. In the arrangement of FIG. 1 the tube would be along a line from 7 o'clock to 2 o'clock with reference to centre 23 when the holder 20 is in the position shown. The tube is closed at both ends and holds a freely movable mass such as a ball or cylinder. The tube can be any suitable cross-section having regard to the shape of the mass. The mass may even be a fluid such as a dense mobile liquid or small lead shot or the like. The tube is positioned so that the mass can move to near the periphery of the water holder at each end of the tube. The tube can permit a symmetrical or asymmetrical motion of the mass.

In operation the mass will initially be at the end of the tube at the 7 o'clock position with the water holder full. Rotation of the water holder for a flush will keep the mass at the end of the tube until the holder stops in the position to dump the water into the flush outlet. The mass can then move under gravity to the other end of the tube and assist the return of the water holder to the initial position the mass eventually moving back to the initial end of the tube as the holder turns to the upright state to bias the holder to be charged with water.

Typical dimensions for the bias device are a tube diameter of 20 to 30 millimeters and a mass of 20 to 50 grams. The tube should be long enough to give sufficient turning action from the mass during its motion, some 100 to 15 millimeters should be suitable for the 6 liter apparatus described.

FIG. 4 shows a form of tube to give a different action on the forward and return movements of the water holder. The bias device 40 is mounted in or on the water holder 420 (shown in outline only) to be just below a diameter and the centre of rotation 423. The device is in the form of a loop of tube with a side arm and contains such a mass 41 as a ball or cylindrical roller. In this embodiment it is likely that only a solid mass is suitable, not a liquid or fluid mass as mentioned above. The loop of tube may contain damping medium such as a liquid which may be viscous e.g. water or a silicone fluid. The tube is arranged to cause one-way circulation of the mass 41. The charged water holder at rest has the attitude shown with mass 41 inside arm 42. On turning the holder in the direction of arrow A4 to cause a flush the mass 41 enters tube part 43 being deflected from tube part 44 by lip 45. The mass is a fairly good fit in tube 43 and does not reach the bend between tube part 43 and 44 so soon as to disturb the dumping of flushing water from the water holder. However once at this bend the mass assists the return of the water holder for recharging, moving freely along the larger bore, curved, part 44 until it re-enters side arm 42 and biasses the water holder into the charging position.

Such a bias device is predictable in its actions being sealed against contamination and scale, and is easier to make and install than the mouldings required for the pockets. The moulding of the holder may be simplified as the bias device can be a separate item attached and replaced as needed.

Instead of a bias arrangement, such as one of those described above, a different form of control of the water holder can be used. Whatever angle of rotation of the water holder is chosen the return of the water holder to the position in which it is charged is controlled by the action of a dash-pot or similar damping device. The working medium of the dash-pot may be air or liquid and could be the water supplied to the cistern.

The water used in the dash-pot could form part of a flush.

Another form of the cistern according to the invention can have a float attached to the water holder, conveniently with the float in the same general position as the float 61 when held on an arm. The water holder itself then acts on the water supply means to control flow and flow is cut off on the float being moved by the action of the rising water to move the water holder a small amount and close the valve of the supply means and stop flow.

It is also possible to shape the water holder and/or adjust the rotational movement to accommodate a conventional ball-valve with a ball float at the end of an arm. Typically a rotation of about 90° from an asymmetric water holder position will allow the float arm to enter the water holder. The downward movement of the arm on starting the emptying of the water holder will avoid too violent an action by the rotating water holder on the arm against the flotation of the ball float.

Rotations of other than 180° can be used with arrangements of the general form shown in the drawings. The outlet 11 can be positioned to one side, say in the region of 4 o'clock to 5 o'clock, with appropriate arrangements for the control of the amount of rotation of the water holder to match the aperture 21 to the outlet 11. In such an arrangement the air-tube 22 may not be needed as the aperture 21 will have the upper part at a position to allow air to enter as water flows out. The outlet 11 will then be in one corner of the housing 10 but still of the hydraulically efficient form described above. Some modification of the standard cistern position for a control outlet may be needed in installations but this should not be a problem.

The arrangment described above provides a compact and water-conserving apparatus with the ability to produce a vigorous flush action at a low flush volume. In some forms the water-supply can be arranged to give an overflow indication of malfunction also providing a "fail-safe" facility. In some forms the water holder can be moved in a conforming housing to dump a charge of water into a hydraulically efficient flow path, part of which may be in the water holder. The various features described may be used individually or selectively in association to produce improved flushing cisterns to meet various requirements, including the local regulations and bye-laws of water authorities.

We claim:

1. A flushing cistern comprising:

a cistern body having a water outlet in the bottom thereof;

a water holder mounted for rotation in said body and having an aperture in the periphery thereof, said holder being rotatable between a first water receiving position wherein said aperture is uppermost and a second water dumping position wherein said aperture is lowermost, said aperture and the entrance to said outlet generally matching in configuration and the portion of the peripheral wall of said holder extending from said aperture in the direction of rotation from said first position to said entrance and the portion of the wall of said body transversed by said aperture during rotation from a position where water can start to flow from said aperture to said second position being substantially conformed to and closely spaced from each other, whereby said body portion obstructs said aperture during rotation from said first to said second position to substantially retain most of the water in said holder until said second position is reached;

means to supply water to said holder in said first position; and manually operable means to rotate said holder from said first to said second position.

2. A cistern according to claim 1 including means to vent air from the water holder in the second position to ensure free dumping.

3. A cistern according to claim 1 including means to limit the speed of rotation of the water holder.

4. A cistern according to claim 1 having a holder water charge of no more than 6 liters and providing a substantially even flushing water flow discharged in less than 2.5 seconds.

5. A cistern according to claim 1 having a holder water charge of no more than 6 liters and providing a sustained average flushing water flow in excess of 1.9 liters per second.

6. A cistern according to claim 1 including a dash-pot to control the return of the water holder to the first position after dumping.

7. The cistern defined in claim 1 wherein the outlet tapers from the entrance to a reduced exit.

8. The cistern defined in claim 1 in which the holder includes bias means for urging said holder to rotate from the second position to the first position.

9. A cistern according to claim 8 in which bias means includes at least one pocket to retain water in the second position and having a vent hole to control flow of retained water from the pocket.

10. The cistern defined in claim 1 in which the holder includes bias means for retaining said holder in the second position until empty.

11. The cistern defined in claim 10 in which the bias means includes a pocket to retain water in said second position and having a vent hole to control flow of retained water from said pocket.

12. The cistern defined in claim 1 in which ther water supply means includes chute means attached to the holder to direct water into said holder only in the first position.

13. The cistern defined in claim 1 in which the water supply means includes automatic means for starting the flow of water in said first position and stopping the flow when the water in the holder reaches a predetermined level.

14. The cistern defined in claim 13 including means for receiving an overflow of water from the holder in the event of failure of the automatic means to stop the flow, and visible drain means for said overflow receiving means to indicate such failure.

15. The cistern defined in claim 13 including means for receiving water from the water supply means in the event of failure of the automatic means and starting the flow in other than the first position, and visible drain means for said receiving means to indicate such failure.

16. A flushing apparatus comprising:

a cistern body having a water outlet in the bottom thereof;

a water holder in said body having an aperture and mounted for movement between a first water receiving position where said aperture is uppermost and a second water dumping position where said aperture is lowermost;

means to supply water to said holder, including deflector means movable with said holder to receive and direct water into said holder only in said first position; and means for receiving and directing the water from said supply means to a visible fault-indicating outlet in the event of water flow from said supply means in other than said first position.

17. A flushing apparatus comprising:

a cistern body having a water outlet in the bottom thereof;

a water holder in said body having an aperture and mounted for movement between a first water receiving position where said aperture is uppermost and a second water dumping position where said aperture is lowermost;

means to supply water to said holder, including automatic means for starting the flow into said holder in said first position and stopping the flow when the water in said holder reaches a predetermined level; and means for receiving and directing to a visible outlet overflow of water from said holder to indicate failure of said automatic means to stop the flow.

* * * * *